US006598293B1

(12) United States Patent
Ide et al.

(10) Patent No.: US 6,598,293 B1
(45) Date of Patent: Jul. 29, 2003

(54) CONNECTING METHOD OF COVERED WIRE

(75) Inventors: Tetsuro Ide, Shizuoka-ken (JP); Akira Mita, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 95 days.

(21) Appl. No.: 09/575,676

(22) Filed: Jun. 22, 2000

(30) Foreign Application Priority Data

Jun. 23, 1999 (JP) ..... P11-177141

(51) Int. Cl.[7] ..... H01R 43/00

(52) U.S. Cl. ..... 29/872; 29/564.4; 29/840; 29/858; 29/868; 29/873; 174/74 R; 174/75 C; 174/75 R; 361/780; 361/803; 228/110.1; 228/175; 228/180.5

(58) Field of Search ..... 29/664.4, 840, 29/858, 860, 868, 872, 873, 867; 174/74 R, 75 C, 175 R, 251, 261, 259; 361/780, 803; 228/140.1, 175, 180.5

(56) References Cited

U.S. PATENT DOCUMENTS 4,878,969 A * 11/1989 Janisch ..... 156/49
5,584,122 A * 12/1996 Kato et al. ..... 29/872
5,869,784 A * 2/1999 Shinchi ..... 174/84 R
6,004,170 A * 12/1999 Kato et al. ..... 439/874
6,046,407 A * 4/2000 Ide ..... 174/78
6,072,123 A * 6/2000 Ide et al. ..... 174/78
6,291,771 B1 * 9/2001 Tanikawa et al. ..... 174/84 R
6,327,777 B1 * 12/2001 Ide et al. ..... 29/868
6,334,251 B1 * 1/2002 Ide ..... 29/857

FOREIGN PATENT DOCUMENTS

| | | |
|---|---|---|
| EP | 0 834 956 A2 | 4/1998 |
| GB | 2 342 068 A | 4/2000 |
| JP | 07320842 | 12/1995 |
| JP | 11128688 | 5/1999 |
| JP | 11135167 | 5/1999 |
| JP | 11250953 | 9/1999 |

* cited by examiner

*Primary Examiner*—Peter Vo
*Assistant Examiner*—Paul D Kim
(74) *Attorney, Agent, or Firm*—Finnegan, Henderson, Farabow, Garrett, & Dunner, L.L.P.

(57) ABSTRACT

A connecting method of connecting covered wires with each other and recessed resinous tips used in the method are provided. In the method, it is executed at the first step to put a connecting part constituted by a shield wire and a ground wire between a first resin tip and a second resin tip. The first resin tip has, around the connecting part, first recessed parts for accommodating the molten cover of the shield wire and second recessed parts for accommodating the molten cover of the ground wire. The second resin tip has second recessed parts formed for accommodating the molten cover of the ground wire.

3 Claims, 4 Drawing Sheets

CONNECTING METHOD OF COVERED WIRE

CROSS-REFERENCE TO RELATED APPLICATIONS

Not Applicable

STATEMENT REGARDING FEDERALLY SPONSORED RESEARCH

Not Applicable

REFERENCE TO A MECROFICHE APPENDIX

Not Applicable

BACKGROUND OF THE INVENTION

1. Description of Related Art

Japanese Patent Publication No. 7-320842 discloses a connecting method of two different covered wires as shown in FIGS. 1A and 1B. The shown method is related to a connection between a shield wire W1 and a ground wire W2. The shield wire W1 has a core line 14 as a conductive part covered with a resinous cover 8 and a shielding braided wire 13 as another conductive part which covers the resinous cover 8 and is also covered with another resinous cover 7. While, the ground wire W2 has a core line 15 as a conductive part covered with a resinous cover 9.

In order to connect the shield wire W1 with the ground wire W2, it is executed at the first step to put the connecting (overlapping) part defined by the wire W1 and the wire W2 between a pair of resinous tips 1, 3. In detail, the resinous tip 3 is inserted into an anvil 5 and subsequently, the shield wire W1 is inserted into the anvil 5 and put on the resinous tip 3. Further, the ground wire W2 is inserted and put on the inserted shield wire W1 and finally, the other resinous tip 1 is laid on the ground wire W2.

At the second step, it is carried out to partially remove the resinous covers 7, 9 of the wires W1, W2 by heating the connecting part defined by the wires W1, W2 under pressure and further seal the resulting connecting part by welding the resinous tips 1, 3 each other. In detail, a horn 11 is inserted from the upside of the resinous tip 1 and continuously, the tips 1, 3 are heated due to ultrasonic oscillations between the horn 11 and the anvil 5 under pressure. Owing to the generation of heat by the ultrasonic oscillations, the covers 7, 9 are molten at the connecting part, so that the braided wire 13 of the shield wire W1 and the core line 15 of the ground wire W2 are exposed together.

While, the so-molten covers 7, 9 are pushed out of the resinous tips 1, 3 through a clearance therebetween, so that the braided wire 13 comes into electrical contact with the core line 15. With further continuation to both oscillate and pressurize, the resinous tips 1, 3 are molten for their integration, so that the connecting part can be sealed as shown in FIG. 1B.

In the above-mentioned connecting method, however, there is a possibility that the shield wire's portion close to the resinous tips 1, 3, i.e., a part 17, is influenced by the heat of the resinous covers 7, 9 pushed out of the resin tips 1, 3 (see FIG. 1B), thereby causing the deterioration of insulation effect, the disconnection of conductive wire, the deterioration of bending, etc.

FIG. 2 shows respective sections of the shield wire W1 and the ground wire W2 in their sealed connection which is somewhat different from the previously-mentioned connecting structure. Shown in the figure is a condition where a resin 19 resulting from the melting of the ground wire W2 is pushed out from the clearance between the resinous tips 1, 3, so that the ground wire W2 is damaged at its part 21 close to the tips 1, 3 by the heat of the so-pushed resin 19, causing the exposure of the core line 15.

Therefore, also in this case, there may be caused problems of the deterioration of insulation effect of the cover 9 at a part of the ground wire W2, the disconnection of the core line 15 and the deterioration of bending, too.

2. Field of the Invention

The present invention relates to a connecting method of connecting two different wires to each other, for example, an electrical connection between a shield wire and a ground wire, and also relates to a pair of recessed resin tips which are appropriate in the connecting method.

BRIEF SUMMARY OF THE INVENTION

Under the circumstances, it is therefore an object of the present invention to provide a connecting method of connecting covered wires with each other, by which it is possible to prevent the molten insulating covers from being pushed out of the resin tips. Further, it is another object of the invention to provide resin tips which are appropriate in connecting the covered wires in accordance with the above method.

The former object of the present invention described above can be accomplished by a connecting method of connecting a first wire with a second wire, the first wire having a first conductive wire covered with a first insulating cover, the second wire having a second conductive wire covered with a second insulating cover, the connecting method comprising:

a first step of putting a connecting part constituted by both of the first and second wires, between a first resin tip and a second resin tip; and a second step of heating the connecting part through the first and second resin tips under pressure thereby to remove the first and second insulating covers from the connecting part while welding the first and second resin tips together thereby to sealing the connecting part. In the method, at least either one of the first and second resin tips is provided, on both sides of the connecting part, with first recessed parts. While, at least either one of the first and second resin tips is provided, on both sides of the connecting part, with second recessed parts. Thus, the molten first insulating cover of the first wire is accommodated in the first recessed parts at the second step, while the molten second insulating cover of the second wire is accommodated in the second recessed parts at the second step.

In this way, it is possible to restrict the first and second covers of the first and second wires from being pushed out of the integrated resin tips, thereby avoiding the damage on the first and second wires due to heat of the so-pushed covers.

In this way, the exposure of the first and second conductive wires outside the first and second resin tips is restricted, so that the bending capabilities of the first and second wires can be maintained without causing the deterioration of insulation effect and the disconnection of the first and second conductive wires, etc.

Additionally, since the molten and removed first and second insulating covers are accommodated in the first recessed parts and the second recessed parts smoothly, it is possible to accomplish the shortage of welding time and the reduction in the number of working processes.

According to the present invention, the latter object of the invention can be accomplished by a combination of first and second resin tips which are usable in a connecting method of connecting a first wire with a second wire, the first wire having a first conductive wire covered with a first insulating cover, the second wire having a second conductive wire covered with a second insulating cover, the connecting method comprising a first step of putting a connecting part constituted by both of the first and second wires, between a first resin tip and a second resin tip and a second step of heating the connecting part through the first and second resin tips under pressure thereby to remove the first and second insulating covers from the connecting part while welding the first and second resin tips together thereby to sealing the connecting part. In this invention, the combination comprises first recessed parts formed at least either one of the first and second resin tips and arranged on both sides of the connecting part, for accommodating the molten first insulating cover of the first wire therein and second recessed parts formed at least either one of the first and second resin tips and arranged on both sides of the connecting part, for accommodating the molten second insulating cover of the second wire.

In the above-mentioned combination, preferably, the first recessed parts and the second recessed parts are continuously formed in one of the first and second resin tips so as to surround the connecting part in annular.

In this case, the molten first insulating cover can flow from the first recessed parts into the second recessed parts or conversely, the molten second insulating cover part can flow from the second recessed parts into the first recessed parts, accomplishing the smooth accommodation of the molten covers.

In the above-mentioned combination, more preferably, the second recessed parts are formed in the other of the first and second resin tips.

In this case, it is possible to accommodate the molten second insulating cover of the second wire more smoothly.

According to the invention, there is also provided a combination of first and second resin tips which are usable in a connecting method of connecting a first wire with a second wire, the first wire having a first conductive wire covered with a first insulating cover, the second wire having a second conductive wire covered with a second insulating cover, the connecting method comprising a first step of putting a connecting part constituted by both of the first and second wires, between a first resin tip and a second resin tip; and a second step of heating the connecting part through the first and second resin tips under pressure thereby to remove the first and second insulating covers from the connecting part while welding the first and second resin tips together thereby to sealing the connecting part.

The above invention is characterized in that the first and second resin tips have respective drawing parts formed to accommodate the first wire to be drawn out of the first and second resin tips, the drawing parts have diameters gradually increased toward the outside ends of the drawing parts.

Then, even if the first wire shakes, the above-mentioned configurations of the first and second resin tips allow the first wire to come into surface contact with the drawing parts in their weakened "edge" effect. Therefore, it is possible to improve the tips' force to retain the first wire at the connecting part and also the bending capability of the first wire in relation to the first and second resin tips.

According to the invention, there is also provided a pair of resin tips used for connecting conductive parts of two different covered wires with each other while removing insulating covers of the wires. In the invention, the pair comprises a first resin tip having a welding part formed at an intermediate portion thereof, first recessed parts formed on both sides of the welding part and second recessed parts also formed on both sides of the welding part, the first and second recessed parts being continuously arranged around the welding part and a second resin tip having recessed parts formed corresponding to the second recessed parts of the first resin tip.

Also in this invention, the operation and effects brought by the pair of resin tips are similar to those brought by the above-mentioned combination of the first and second resin tips.

Also in this invention, preferably, the welding part of the first resin tip has a semicircular-shaped recessed part formed for accommodating one of the wires and semicircular-shaped stepped parts arranged on both sides of the recessed part and also formed deeper than the semicircular-shaped recessed part.

Then, it is possible to restrict the first and second covers of the first and second wires from being pushed out of the integrated resin tips, thereby avoiding the damage on the first and second wires due to heat of the so-pushed covers.

Also in this invention, more preferably, the first and second resin tips have respective drawing parts formed to accommodate one of the wires to be drawn out of the first and second resin tips, the drawing parts have diameters gradually increased toward the outside ends of the drawing parts.

Similarly, it is possible to improve the tips' force to retain the first wire at the connecting part and also the bending capability of the first wire in relation to the first and second resin tips.

These and other objects and features of the present invention will become more fully apparent from the following description and appended claims taken in conjunction with the accompany drawings.

BRIEF DESCRIPTION OF THE DRAWINGS

FIGS. 1A and 1B are perspective views for explanation of the connecting method in the earlier art, in which FIG. 1A is a perspective view showing the first step of the method and FIG. 1B is a perspective view showing the resulting connecting structure;

DESCRIPTION OF THE PREFERRED EMBODIMENT

Embodiments of the present invention will be described with reference to the drawings.

Figure 3A:
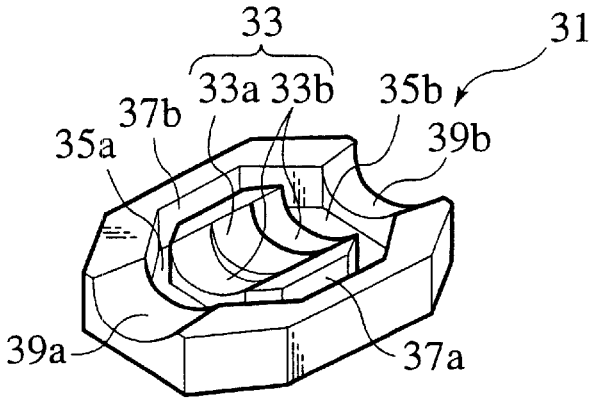
FIG. 3A is a perspective view of an upper resinous tip in accordance with the first embodiment of theinvention, showing a condition to arrange its recessed lower face upward.
Figure 3B:
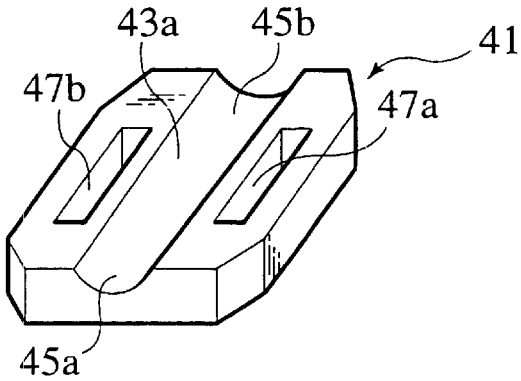
FIG. 3B is a perspective view of a lower resinous tip in accordance with the first embodiment of the invention, showing a condition to arrange its recessed upper face upward.

FIGS. 3A and 3B shows upper and lower resin tips in accordance with the first embodiment. FIG. 3A is a perspective view of the upper resin tip showing its recessed face directing upward. FIG. 3B is a perspective view of the lower resin tip showing its recessed face directing upward.

The upper resin tip 31 has a welding part 33 formed at its intermediate portion. The welding part 33 includes a semicircular-shaped recessed part 33*a* for accommodating the connecting part of the shield wire W1 (FIG. 4) and the ground wire W2 (FIG. 4) and stepped parts 33*b*, 33*b* arranged on both sides of the recessed part 33*a* in a direction to draw out the shield wire W1. The stepped parts 33*b*, 33*b* are also semicircular-shaped in sections. The depth of each stepped part 33*b* is larger than that of the recessed part 33*a*. Around the welding part 33 of the upper resin tip 31, first recessed parts 35*a*, 35*b* are respectively defined on both sides of the welding part 33 in the direction to draw out the shield wire (first wire) W1. While, second recessed parts 37*a*, 37*b* are respectively defined on both sides of the welding part 33 in the direction to draw the ground wire (second wire) W2.

These first recessed parts 35*a*, 35*b* and the second recessed parts 37*a*, 37*b* are continuously formed so as to surround the welding part 33, providing an annular groove surrounding the connecting part between the shield wire W1 and the ground wire W2.

Adjacent to the recessed parts 35*a*, 35*b*, the upper resin tip 31 further includes recessed parts 39*a*, 39*b* formed for holding and drawing out the shield wire W1. The recessed parts 39*a*, 39*b* are shaped to have semicircular sections for accommodating the wire W1. Note that these recessed parts 39*a*, 39*b* may be referred "drawing parts 39*a*, 39*b*," hereinafter. Similar to the upper resin tip 31, the lower resin tip 41 has a semicircular-shaped groove formed along the direction to draw out the shield wire W1. The straight groove consists of a recessed part 43*a* positioned at the center of the groove to accommodate the connecting part between the shield wire W1 and the ground wire W2, and recessed parts 45*a*, 45*b* interposing the recessed part 43*a* therebetween. Also note that these recessed parts 45*a*, 45*b* may be referred "drawing parts 45*a*, 45*b*," hereinafter.

According to the embodiment, the lower resin tip 41 has two recesses 47*a*, 47*b* formed adjacently to the straight groove. The recesses 47*a*, 47*b* of the tip 41 are positioned so as to correspond to the second recessed parts 37*a*, 37*b* of the upper resin tip 31 when it is overlaid with the tip 41. For this reason, the recesses 47*a*, 47*b* will be called "second recessed parts 47*a*, 47*b*" after.

Figure 1A:
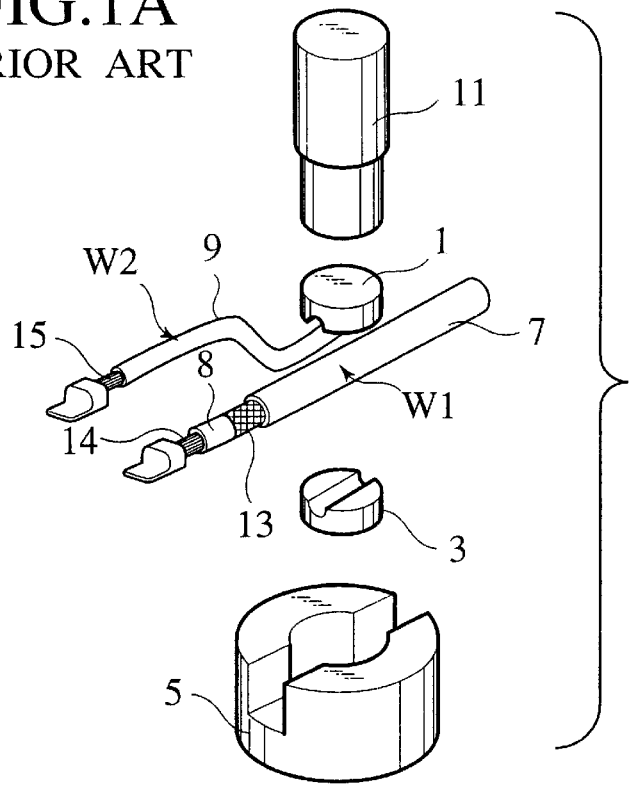
FIG.1A PRIOR ART
Figure 1B:
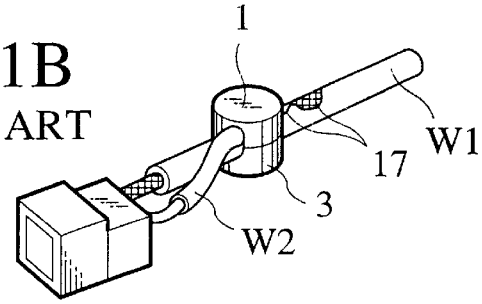
FIG.1B PRIOR ART
Figure 4:
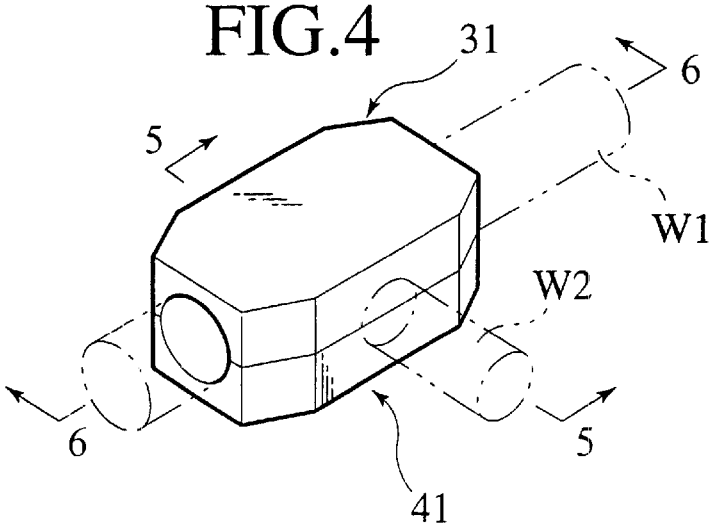
FIG. 4 is a perspective view of the integrated upper and lower resinous tips under their sealed condition.

Also in this embodiment, the connecting part between the shield wire W1 and the ground wire W2 can be obtained and sealed by the tips 31, 41 in accordance with the first step and the second step previously described with reference to FIGS. 1A and 1B. FIG. 4 shows the resultant connecting structure as the completion of welding.

Figure 5:
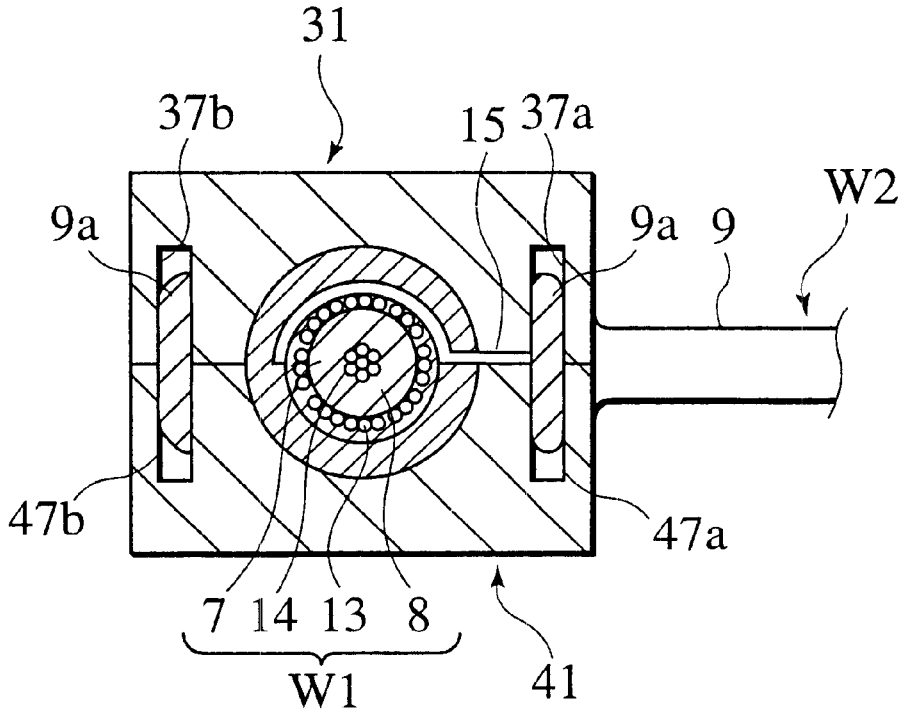
FIG. 5 is a sectional view of the integrated tips, taken along a line 5—5 of FIG. 4.
Figure 6:
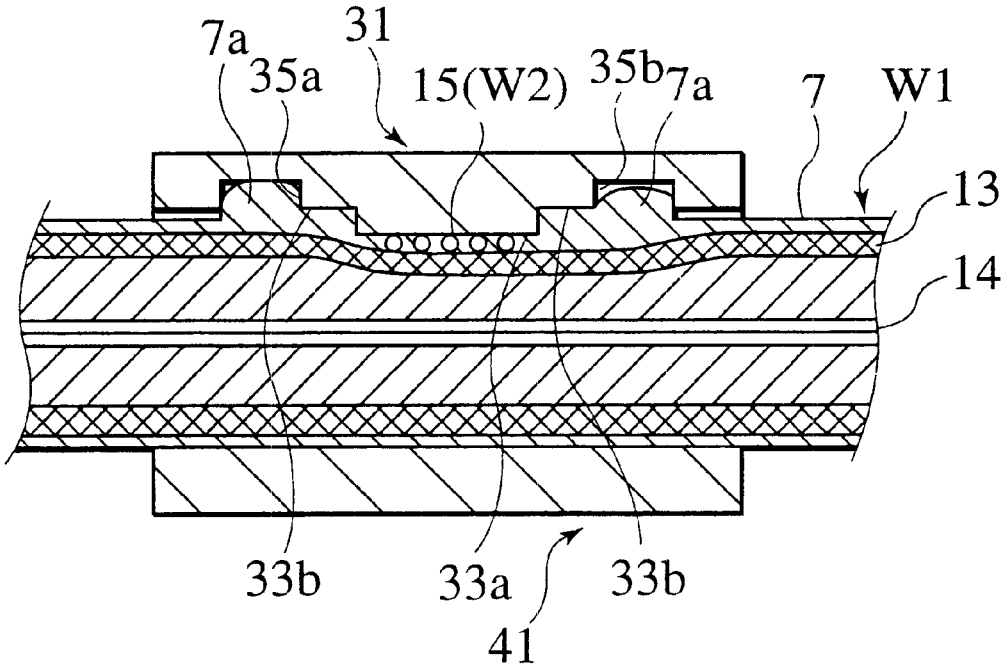
FIG. 6 is a sectional view of the integrated tips, taken along a line 6—6 of FIG. 4.

During the welding operation, the resultant molten cover part 9*a* of the ground wire W2 is accommodated in the second recessed parts 37*a*, 47*a*, 37*b*, 47*b* at the second step since they are all formed in the tips 31, 41 along a direction to arrange the ground wire W2. FIG. 5 shows the cover part 9*a* being accommodated in the second recessed parts 37*a*, 47*a*, 37*b*, 47*b*. While, as shown in FIG. 6, the resultant molten cover part 7*a* of the shield wire W1 is accommodated in an area from the stepped parts 33*b* to the first recessed parts 35*a*, 35*b* at the second step. In the embodiment, the recessed part 33*a* is formed to have a width generally equal to the width of the ground wire W2, while the stepped parts 33*b*, 33*b* are provided on both sides of the recessed part 33*a*. Therefore, the molten cover part 7*a* of the shield wire W1 can be easily removed away from the recessed part 33*a*.

Therefore, it is possible to restrict the cover parts 9*a*, 7*a* of the wires W2, W1 from being pushed out of the resin tips 31, 41, thereby avoiding the damage on the wires W2, W1 due to heat of the so-pushed cover parts 9*a*, 7*a*.

In this way, the exposure of the conductive parts (i.e. the braided wire 13 and the core line 15) outside the resin tips 31, 41 is restricted, so that the bending capabilities of the wires W1, W2 can be maintained without causing the deterioration of insulation effect and the disconnection of the braided wire 13, the core line 15, etc.

Additionally, since the molten and removed cover parts 9*a*, 7*a* are accommodated in the first recessed parts 35*a*, 35*b* and the second recessed parts 37*a*, 47*a*, 37*b*, 47*b* smoothly, it is possible to accomplish the shortage of welding time and the reduction in the number of working processes.

Further, since the upper resin tip 31 has the first recesses parts 35*a*, 35*b* and the second recessed parts 37*a*, 37*b* formed in annular, the molten cover part 7*a* can flow from the first recessed parts 35*a*, 35*b* into the second recessed parts 37*a*, 37*b* or conversely, the molten cover part 9*a* can flow from the second recessed parts 37*a*, 37*b* into the first recessed parts 35*a*, 35*b*, accomplishing the smooth accommodation of the molten resin.

Moreover, since the upper and lower resin tips 31, 41 of the embodiment are provided with the second recessed parts 37*a*, 47*a*, 37*b*, 47*b* as shown in FIG. 5, the molten cover part 9*a* of the ground wire W2 can be accommodated and maintained in the resin tips 31, 41 more smoothly. That is, it is possible to prevent the ground wire W2 from being damaged and also possible to shorten the welding time.

Figure 2:
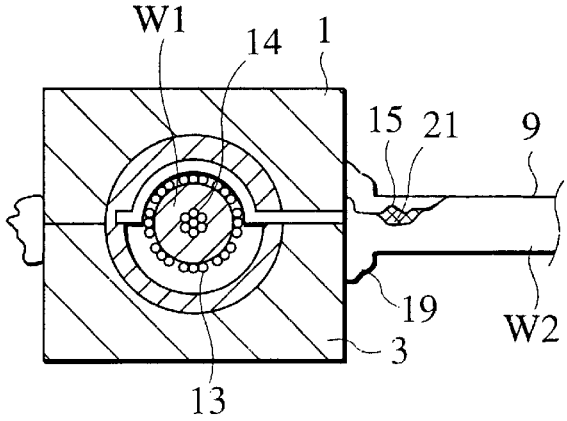
FIG.2 PRIOR ART
FIG. 2 is a sectional view of the connecting structure for explanation of its problems.
Figure 7A:
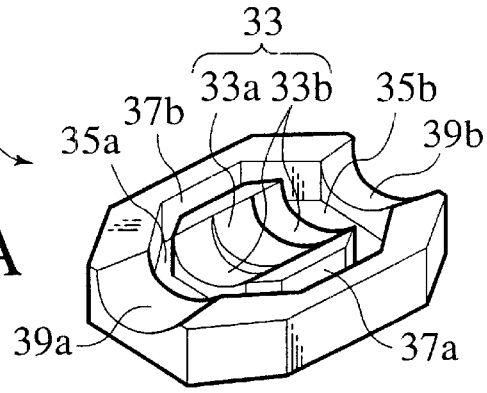
FIG. 7A is a perspective view of an upper resinous tip in accordance with the second embodiment of the invention, showing a condition to arrange its recessed lower face upward.
Figure 7B:
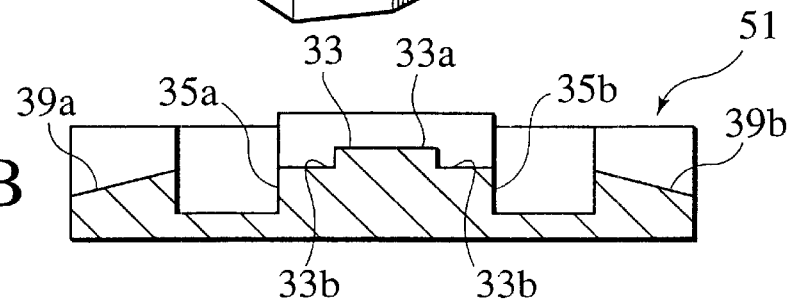
FIG. 7B is a sectional view of FIG. 7A.
Figure 7C:
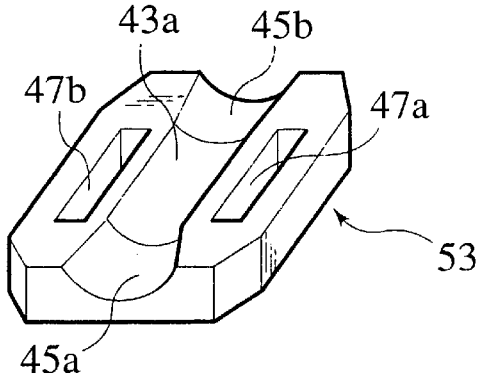
FIG. 7C is a perspective view of a lower resinous tip in accordance with the second embodiment of the invention, showing a condition to arrange its recessed upper face upward.

FIGS. 7A to 7C show another embodiment of the present invention. In the figures, FIG. 7A is a perspective view of an upper resin tip 51, FIG. 2 a sectional view of the FIG. 7A. and FIG. 7C is a perspective view of an lower resin tip 53.

Also in this embodiment, essential constituents of the upper and lower resin tips 51, 53 are similar to those of the above-mentioned resin tips 31, 41, respectively. Therefore, the respective parts of the tips 51, 53 are indicated with the same reference numerals of the corresponding part of the tips 31, 41, respectively, and their overlapping descriptions are omitted.

According to the embodiment, the drawing parts 39*a*, 39*b* of the upper resin tip 51 and the drawing parts 45*a*, 45*b* of the lower resin tip 53 are all tapered in section so as to have diameters gradually increased toward the outside ends of the parts 39*a*, 39*b*, 45*a*, 45*b*, that is, opposing ports for drawing out the shield wire W1.

Figure 8:
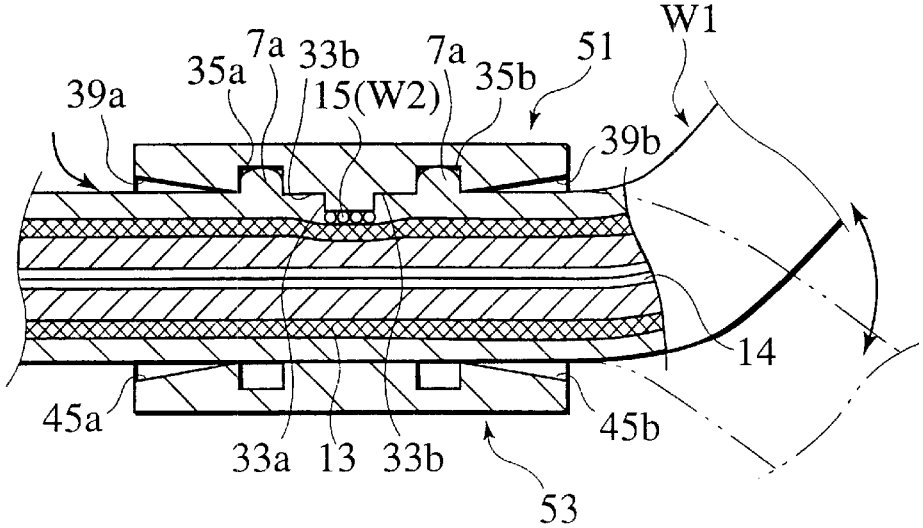
FIG. 8 is a sectional view of the integrated tips of the second embodiment, for explanation of the operation of the integrated tips.

Thus, even if the shield wire W1 shakes as shown in FIG. 8, the above-mentioned configurations of the tips 51, 53 allow the wire W1 to come into surface contact with the drawing parts 39*b,* 45*b* in their weakened "edge" effect. Therefore, it is possible to improve the tips' force to retain the shield wire W1 at the welding part 33 and also the bending capability of the wire W1 in relation to the tips 51, 53.

Although the first recessed parts 35*a,* 35*b* and the second recessed parts 37*a,* 37*b* are annular-formed in the upper resin tip 31(51 ) in common with the above-mentioned embodiments, these parts 35*a,* 35*b,* 37*a,* 37*b* may be provided in the lower resin tip 41 (53) in the modification. Alternatively, they may be provided in both of the upper and lower resin tips.

In common with the embodiments, the second recessed parts 47*a,* 47*b* of the lower resin tip 41(53) may be eliminated in the modification. Similarly, in case of forming the first and second recessed parts 35*a,* 35*b,* 37*a,* 37*b* in the lower resin tip 41(53), the upper resin tip 31(51) may be provided with no recess.

Furthermore, either one of the upper and lower resin tips 31, 41(51, 53) may be provided with the first recessed parts 35*a,* 35*b* while the other of the tips is provided with the second recessed parts 37*a,* 37*b,* equally.

It will be understood by those skilled in the art that the foregoing description relates to embodiments of the disclosed connecting method and the resin tips used for the method. Various changes and modifications may be made to the present invention without departing from the scope of the invention.

Deposit of Computer Program Listings

Not Applicable

What is claimed is:

1. A connecting method of connecting a first wire with a second wire, the first wire having a first conductive wire covered with a first insulating cover, the second wire having a second conductive wire covered with a second insulating cover, each of the first and second wires including a connecting part, the connecting method comprising:

providing first and second resin tips, at least one of the first and second resin tips including first recessed parts and at least one of the first and second resin tips including second recessed parts;

putting the connecting parts of the first and second wires between the first resin tip and the second resin tip;

heating the connecting parts through the first and second resin tips under pressure thereby melting the first and second insulating covers from the connecting parts to produce molten first and second insulating covers, respectively, while welding the first and second resin tips together thereby sealing the connecting parts; and preventing the molten first and second insulating covers from being pushed out of the first and second resin tips by accommodating the molten first and second insulating covers in the first and second recessed parts, wherein all of the molten first insulating cover is accommodated in the first recessed parts and all of the molten second insulating cover is accommodated in the second recessed parts.

2. A connecting method of connecting a first wire with a second wire, the first wire having a first conductive wire covered with a first insulating cover, the second wire having a second conductive wire covered with a second insulating cover, each of the first and second wires including a connecting part, the connecting method comprising:

providing first and second resin tips, at least one of the first and second resin tips including first recessed parts and at least one of the first and second resin tips including second recessed parts;

putting the connecting parts of the first and second wires between the first resin tip and the second resin tip;

heating the connecting parts through the first and second resin tips under pressure thereby melting the first and second insulating covers from the connecting parts to produce molten first and second insulating covers, respectively, while welding the first and second resin tips together thereby sealing the connecting parts; and preventing the molten first and second insulating covers from being pushed out of the first and second resin tips by accommodating the molten first and second insulating covers in the first and second recessed parts, wherein all of the molten first insulating cover and at least a portion of the molten second insulating cover are accommodated in the first recessed parts.

3. A connecting method of connecting a first wire with a second wire, the first wire having a first conductive wire covered with a first insulating cover, the second wire having a second conductive wire covered with a second insulating cover, each of the first and second wires including a connecting part, the connecting method comprising:

providing first and second resin tips, at least one of the first and second resin tips including first recessed parts and at least one of the first and second resin tips including second recessed parts;

putting the connecting parts of the first and second wires between the first resin tip and the second resin tip;

heating the connecting parts through the first and second resin tips under pressure thereby melting the first and second insulating covers from the connecting parts to produce molten first and second insulating covers, respectively, while welding the first and second resin tips together thereby sealing the connecting parts; and preventing the molten first and second insulating covers from being pushed out of the first and second resin tips by accommodating the molten first and second insulating covers in the first and second recessed parts, wherein all of the molten second insulating cover and at least a portion of the molten first insulating cover are accommodated in the second recessed parts.

* * * * *